US006916780B2

(12) United States Patent
Fry et al.

(10) Patent No.: US 6,916,780 B2
(45) Date of Patent: Jul. 12, 2005

(54) FABRIC TREATMENT COMPOSITION

(75) Inventors: Alan John Fry, Ellesmere Port (GB); Mansur Sultan Mohammadi, Wirral (GB)

(73) Assignee: Unilever Home & Personal Care USA, a division of Conopco, Inc., Greenwich, CT (US)

( * ) Notice: Subject to any disclaimer, the term of this patent is extended or adjusted under 35 U.S.C. 154(b) by 150 days.

(21) Appl. No.: 10/413,969

(22) Filed: Apr. 15, 2003

(65) Prior Publication Data

US 2003/0199416 A1 Oct. 23, 2003

(30) Foreign Application Priority Data

Apr. 16, 2002 (GB) ..... 0208695

(51) Int. Cl.[7] ..... C11D 1/835
(52) U.S. Cl. ..... 510/519
(58) Field of Search ..... 510/515, 516, 510/519, 520

(56) References Cited

U.S. PATENT DOCUMENTS

| | | | | |
|---|---|---|---|---|
| 3,634,947 | A | 1/1972 | Furgal | |
| 4,014,105 | A | 3/1977 | Furgal et al. | |
| 4,014,432 | A | 3/1977 | Clothier et al. | |
| 4,049,858 | A | 9/1977 | Murphy | |
| 4,053,992 | A | 10/1977 | Furgal | |
| 4,139,475 | A | 2/1979 | Schwadtke et al. | |
| 4,149,977 | A | 4/1979 | Morganson et al. | |
| 4,642,908 | A | 2/1987 | Brenner | |
| 5,040,311 | A | 8/1991 | Roy | |
| 5,066,413 | A | 11/1991 | Kellett | |
| 5,425,887 | A | 6/1995 | Lam et al. | |
| 5,787,606 | A | 8/1998 | Bokholdt | |
| 5,966,831 | A | 10/1999 | Anderson | |
| 6,143,703 | A | 11/2000 | Cheung et al. | |
| 6,376,455 | B1 * | 4/2002 | Friedli et al. | 510/515 |
| 6,620,437 | B2 * | 9/2003 | Ewbank et al. | 424/489 |
| 6,734,153 | B2 * | 5/2004 | Scheper | 510/285 |
| 2002/0010104 | A1 | 1/2002 | Tummers et al. | |

FOREIGN PATENT DOCUMENTS

| | | |
|---|---|---|
| CA | 1005204 | 2/1977 |
| EP | 0 361 539 | 9/1992 |
| EP | 0 539 025 | 4/1993 |
| EP | 0 459 821 | 12/1995 |
| EP | 1 076 088 A | 2/2001 |
| GB | 1 399 728 | 7/1975 |
| GB | 2 066 309 | 7/1981 |
| WO | 97/26316 | 7/1997 |
| WO | 97/42290 | 11/1997 |
| WO | 00/58428 | 10/2000 |
| WO | 01/04254 A | 1/2001 |
| WO | 02/33160 | 4/2002 |
| WO | 02/33161 | 4/2002 |

OTHER PUBLICATIONS

*International Search Report No. PCT/EP 03/02701 dated Jul. 7, 2003, 4 pp.*
*UK Search Report No. GB 0208695.7 dated Oct. 7, 2002, 1 page.* WPI Acc. No. 1987–207162/198730 Derwent Abstract of EP 0 361 539—3 pp.

* cited by examiner

*Primary Examiner*—John R. Hardee
(74) *Attorney, Agent, or Firm*—Ellen Plotkin

(57) ABSTRACT

A heat activated fabric treatment composition comprises from 3 to 75 wt % of one or more fabric treatment active ingredients, from 10 to 50 wt % of water, from 5 to 40 wt % of an oil and optionally from 2 to 30 wt % of a nonionic surfactant. The composition is provided in a dispensing device which, in use, is attached to the internal panel of a tumble dryer.

9 Claims, No Drawings

FABRIC TREATMENT COMPOSITION

FIELD OF THE INVENTION

The present invention relates to a fabric treatment composition. More particularly, the invention relates to a heat activated fabric treatment composition for use in a tumble dryer.

BACKGROUND OF THE INVENTION

In the treatment of fabrics in a tumble dryer it is known to add one or more conditioning agents together with the load to be dried. For instance, for imparting a softening benefit to fabrics it is known from CA 1,005,204 to co-mingle fabrics in a tumble dryer with a flexible substrate carrying a normally solid fabric conditioning agent. In co-mingling fabrics with impregnated substrates, however, there is a risk that the conditioner may not be evenly distributed. Furthermore, the co-mingling of the fabrics with impregnated substrates requires the separation of the substrate from the fabrics after the completion of the tumble dryer treatment. This separation is often time-consuming in that the substrates cannot readily be located.

Other disadvantages of such products include uneven product distribution following entanglement of the substrate with fabrics which can lead to greasy marks on fabrics (staining) and the tendency of such substrates to become positioned over the tumble dryer vent, thus giving virtually no benefit to the fabrics during a tumble drying cycle. Furthermore, these products are designed for single use only and therefore need to be replaced after every cycle. In addition, perfume delivery from the substrate onto fabrics is often poor resulting in consumers using additional substrates to deliver adequate perfume which is wasteful of resources.

For overcoming these problems it has been suggested, for instance in GB 2,066,309 and U.S. Pat. No. 3,634,947, to use conditioner dispensing articles, comprising means for attachment of the substrate to the tumble dryer wall. Other proposals, such as for instance disclosed in GB 1,399,728, involve the use of separate means for attaching the conditioning article to the tumble dryer wall.

EP-B-361593 concerns an alternative approach in which a fabric conditioning article comprises a combination of a substrate and a fabric conditioning composition, the substrate being a porous material with a specified void volume and cell count. The article of EP-B-361593 is designed to adhere to the tumble dryer wall.

U.S. Pat. No. 4,053,992 discloses a hemispherical device that fits onto the door of a tumble dryer and delivers fabric conditioner from sheets.

U.S. Pat. No. 5,787,606 discloses a dispenser on the door of a tumble dryer containing a roll of tumble dryer sheets.

WO-A-97/42290 discloses solid compositions that can be delivered by any convenient applicator fixed to the door or to the surface of the drum of the tumble dryer.

U.S. Pat. No. 5,040,311 discloses a device for use inside a tumble dryer for delivering a conventional aqueous fabric conditioners where the fabric conditioner migrates outwardly to the surface of the device to become engaged with clothes because of the heat and tumbling in the dryer. Staining from such liquid fabric conditioners that "wet" fabrics is mentioned.

U.S. Pat. No. 5,966,831 discloses a foam carrier for the inside of a tumble dryer impregnated with microencapsulated fluid where the microcapsules rupture because of mechanical and heat action.

U.S. Pat. No. 4,642,908 discloses a valve-containing device attached to the non-rotating head of a tumble dryer drum for delivering accurate and metered amounts of a fluid.

U.S. Pat. No. 4,014,105 discloses a device with multiple openings for the inside of a tumble dryer. Aqueous liquid conditioners are referred to, but the product is permanently in a liquid state and thus does not address the problem of leakage from the dispensing device during storage.

EP-A2-0539025 discloses fragrance microcapsules for fabric conditioning. The microcapsules are spray dried and incorporated into a tumble dryer article.

EP-A1-0459821 discloses a liquid fabric conditioning composition and an article for conditioning fabrics in an automatic laundry dryer. The liquid composition is not heat activated and the tumble dryer article does not container water.

U.S. Pat. No. 5,425,887 discloses a tumble dryer article comprising a fabric conditioning composition having little or substantially no free water.

In our co-pending applications, WO-A1-02/33160 and WO-A1-02/33161, there are disclosed articles suitable for treatment fabrics in a tumble dryer. The compositions of the present invention are particularly suitable for use with such devices.

In order to optimise the delivery of the active material onto fabrics during the drying cycle, it is desirable to provide a fabric treatment composition which, at a temperature below the heating cycle temperature of the tumble dryer, remains substantially within a dispensing article and is capable of undergoing a transition during the heating cycle of a tumble dryer such that it can be dispensed from the dispensing article It is, therefore, desirable to provide a fabric treatment composition which is capable of undergoing such transitions without unacceptable instability. It is particularly desirable that the composition can undergo such a cycle repeatedly.

U.S. Pat. No. 4,014,432 relates to a product for fabrics treatment in tumble drying machines. Disclosure is made of conditioning agents which are normally solid at room temperature and soften sufficiently at the tumble dryer operating temperature to be exuded through perforations within the product. The conditioning agent is preferably a quaternary ammonium fabric softening agent in admixture with a nonionic surfactant. A very brief reference is made to aqueous solutions or dispersions and, in the examples, compositions comprising either a 1.8% aqueous solution of 3-alkoyloxy-2-hydroxypropyl trimethyl ammonium chloride or a 4.8% aqueous solution of lauryl dimethyl ammonio propane sulphonate are disclosed. There is no reference to the consumer perceivable problem of staining.

Effective delivery of a fabric treatment composition from a device such as described above requires the composition to be flowable at the delivery temperature (i.e. the heating temperature of the tumble dryer). The inventors have identified a problem with fabric treatment compositions which are suitable to be delivered onto fabrics in a liquid state in that they can leave stain marks on the treated fabric.

Fabric staining is referred to in U.S. Pat. No. 5,066,413, U.S. Pat. No. 4,049,858, WO-A-97/42290 and U.S. Pat. No. 4,149,977. However, this is in relation to tumble dryer sheet conditioning compositions only.

The problem of staining is particularly associated with distributing a substantially liquid product during the heating cycle of a domestic tumble dryer. For this reason, liquid fabric treatment compositions are usually delivered in a washing machine rinse cycle and not in a tumble dryer heating cycle.

Without wishing to be bound by theory, the applicants believe that the visibility of such stains originates from the reduction in the reflection of light from the surface of the stained fabric compared to the reflection from adjacent unstained part of the fabric. More particularly, the visibility of the stain is due to the difference in the refractive index of the fibre of the fabric and that of the composition delivered.

It is also believed that the level of staining is affected by whether the delivered composition fills the spaces between fibres or spreads on the fibres themselves. The stain becomes more visible if the air between the fibres is replaced with the composition since this reduces the difference in refractive index between the fibre and the surrounding fabric giving rise to more transmitted light and less reflection.

The visibility of a stain is also believed to be affected by the thickness and evenness of spreading of the composition onto fabrics. Thin, even spreading of the composition is most desirable and thus viscosity and surface tension characteristics of the fabric treatment composition which improve thin, even spreading are particularly desirable.

Nevertheless, a composition which is delivered as a liquid onto fabrics is desirable since it is believed that a liquid will be dispensed and distributed evenly during delivery.

Accordingly, it is desirable to provide a heat activated fabric treatment composition which can be delivered as a liquid during the heating cycle of a tumble dryer from a dispensing device and which addresses the problem of staining.

Furthermore, it is desirable to provide a heat activated fabric treatment composition which delivers anti-static benefits. Additionally, it is desirable to provide good perfume longevity and/or perfume substantivity to fabrics treated using the compositions of the invention.

It is further desirable to provide a heat activated fabric treatment composition which can be stored in a dispensing device and which can undergo repeated cycles from a more viscous storage state to a less viscous dispensable state such that during the heating cycle of the tumble dryer at least part of the composition is delivered to fabrics.

OBJECTS OF THE INVENTION

The present invention seeks to address one or more of the abovementioned problems and to provide one or more of the abovementioned benefits.

STATEMENT OF INVENTION

Thus, according to the present invention there is provided a heat activated fabric treatment composition comprising:

(a) from 3 to 75 wt % of one or more fabric treatment active ingredients;

(b) from 10 to 50 wt % of water;

(c) from 5 to 40 wt % of an oil; and (d) optionally from 2 to 30 wt % of a nonionic surfactant.

According to a further aspect of the invention there is provided a package comprising a composition as defined above within a dispensing device.

The invention further provides a method of conditioning fabrics in a tumble dryer comprising providing the heat activated fabric treatment composition in a dispensing device, locating the dispensing device on the internal panel of the door of the tumble dryer, inserting fabrics into the tumble dryer and operating the dryer to cause at least a part of the fabric treatment composition to be dispensed from the device onto the fabrics being dried so as to condition the fabrics.

DETAILED DESCRIPTION OF THE INVENTION

In the context of the present invention, "heat activated" means that composition is suitable for use in a domestic tumble dryer, and preferably means that the composition is substantially solid at ambient temperature, i.e. 20° C. and undergoes a transition to a substantially liquid state at the heating temperature of a domestic tumble dryer.

Since the heating temperature of a domestic tumble dryer is typically within the range from about 40° C. to about 80° C., it is particularly preferred that the composition is substantially solid at temperatures below 30° C., more preferably below 32° C., most preferably below 35° C., e.g. below 37° C. and is substantially liquid, or at least mobile, at temperatures above 45° C., more preferably above 40° C., most preferably above 37° C. It is desirable that the composition is fully melted at temperatures above 50° C.

According to one method of defining the temperature at which the composition flows, it is desirable that the slip point of the composition is greater than 30° C. and less than 50° C., more preferably greater than 35° C. and less than 47° C., most preferably greater than 37° C. and less than 45° C.

The slip point of the composition is measured as defined by British Standard BS 684 section 1.3 1991 ISO 6321:1991 (UK).

Product Form

In order to provide a fabric treatment composition capable of remaining substantially within a dispensing device during storage and being delivered to fabrics during the heating cycle of a tumble dryer, it is important that the composition has viscosity characteristics which allow the transition from a storage state to a dispensing state to occur at or about the heating temperature of the heat cycle. That is, the composition should preferably be a non-flowing, high viscosity product at ambient temperatures, e.g. a solid, soft solid or gel, and should become a low viscosity product, e.g. a liquid, at the heating temperatures of the tumble dryer.

Most preferably the composition is a "gel" at ambient temperature comprising a crystalline state forming a network to give the composition a non-flowing gel or gel-like consistency. At the heating temperature of the tumble dryer, the composition is most preferably a "sol" comprising a clear or isotropic solution.

Ideally, at the heating temperature the composition is a single phase or, if multi-phasic, the dispersed phase has unit sizes smaller than a typical membrane pore size of a dispensing device. A typical membrane has a pore size in the range of 0.1–10 microns. For pore sizes much smaller than this dispensing becomes difficult whilst for much larger pore sizes, too much composition is released per cycle, thereby increasing the risk of staining.

Typically the composition will have a viscosity of above 375 mPa.s at a shear rate of 100 $s^{-1}$ at ambient temperature, more preferably above 450 mPa.s, most preferably above 500 mPa.s, e.g. above 600 mPa.s. The viscosity of the composition at ambient temperature can be measured by melting the composition (if necessary), transferring it to a viscometer cup and then letting it cool to room temperature with gentle shearing.

At the heating temperature of a domestic tumble dryer, the composition will typically have a viscosity of below 350 mPa.s at 100 $s^{-1}$, more preferably below 300 mPa.s, most preferably below 250 mPa.s, e.g. below 200 mPa.s.

Measurements can be made using a Haake Rotoviscometer RV20 cup and bob NV1.

In order to provide optimal anti-staining benefits together with improved delivery of the composition to fabrics and better cycling between the storage state and dispensing state, the carrier system for the active ingredient(s) comprises water and an oil. Optionally, the carrier system also comprises a nonionic surfactant.

Water

The compositions of the invention comprise water.

The water-based nature of the compositions of the present invention is believed to help reduce staining and is unlike conventional tumble dryer sheets which are substantially non-aqueous.

Water is present at a level of from 10 to 50%, preferably from 15 to 40%, more preferably from 20 to 35% by weight, based on the total weight of the composition.

Oil

One or more oils is present in the compositions of the invention.

In the present invention, it has been found that excellent perfume delivery can be achieved in the presence of the oil.

Suitable oils include mineral/hydrocarbon oils, ester oils, sugar ester oils, silicone oils and/or natural oils such as vegetable oils. However, natural oils or mineral oils are preferred.

Mineral oils comprise a hydrocarbon oil containing substantially only carbon and hydrogen. The hydrocarbon oils are preferably substantially free of aromatic components and are fully saturated. Suitable hydrocarbon oils can comprise a mixture of different chain length hydrocarbons, e.g. from $C_8$ to $C_{40}$, having various degrees of branching. The hydrocarbon oils are preferably aliphatic.

Preferred mineral oils include the Marcol technical range of oils (ex Esso) although particularly preferred are the Sirius range (ex Fuchs), the Semtol range (ex Goldschmidt), or the Merkur Tec range (ex Merkur Vaseline).

The molecular weight of the mineral oil is typically within the range 100 to 400.

The ester oils are hydrophobic in nature. They include fatty esters of mono or polyhydric alcohols having from 1 to 24 carbon atoms in the hydrocarbon chain, and mono or polycarboxylic acids having from 1 to 24 carbon atoms in the hydrocarbon chain, provided that the total number of carbon atoms in the ester oil is equal to or greater than 16, and that at least one of the hydrocarbon chains has 12 or more carbon atoms.

Suitable ester oils include substantially saturated ester oils (i.e. having less than 10% by number of unsaturated carbon-carbon bonds), such as the PRIOLUBES (ex. Unichema). 2-ethyl hexyl stearate (PRIOLUBE 1545), neopentyl glycol monomerate (PRIOLUBE 2045) and methyl laurate (PRIOLUBE 1415) are particularly preferred although oleic monoglyceride (PRIOLUBE 1407) and neopentyl glycol dioleate (PRIOLUBE 1446) are also suitable.

Other suitable esters oils include fatty acid glyceride esters as defined in EP-A1-0746603, e.g. palm oil and tallow oil.

Suitable oily sugar ester compounds include the sugar ester oils defined in WO-A-98/16538, which are hereby incorporated by reference. The oily sugar esters preferably have a viscosity of from 5 to 50 Pa.s, and preferably have a density of from 0.8 to 1.2 $gcm^{-3}$, more preferably from 0.9 to 1 $gcm^{-3}$, most preferably from 0.93 to 0.99 $gcm^{-3}$.

It is preferred that the viscosity of the ester oil is from 0.002 to 2.0 Pa.S, more preferably from 0.004 to 0.4 Pa.s at a temperature of 25° C. at 106 $s^{-1}$, measured using a Haake rotoviscometer RV20 NV cup and bob, and that the density of the mineral oil is from 0.8 to 0.9 $g.cm^{-3}$ at 25° C.

Suitable silicone oils comprise low molecular weight, e.g. less than 1000, oils. Preferably the oils are volatile. A suitable commercially available silicone oils is DC 245, ex Dow Chemicals.

The most preferred oils for use in the present invention are natural oils, particularly plant-based oils. Suitable plant-based oils include grape seed oil, rape seed oil, wheatgerm oil, castor oil, corn oil, cottonseed oil, olive oil, rapeseed oil, safflower seed oil, jojoba oil, evening primrose oil, avocado oil and tea tree oil. These oils have higher polarity and unsaturation levels than typical mineral oils and are thus believed to deliver better anti-static benefits on their own and in combination with the fabric treatment active ingredient.

One or more oils of any of the above mentioned types may be used, although it is particularly preferred that the oil has substantially no surface activity.

It is believed that at the delivery temperature of the tumble dryer, the oil and water form a water-in-oil microemulsion with the aid of the fabric treatment active ingredient.

An unexpected benefit of microemulsion compositions is that the amount of staining is less dependent on the amount of delivery of the composition per heating cycle of the tumble dryer than for traditional tumble dryer sheets. This is advantageous over prior art systems such as disclosed in U.S. Pat No. 4,149,977, which typically must rely on maintaining full control over the amount of composition delivered in each cycle to control staining.

The presence of oil has also been found to substantially improve perfume delivery to fabrics and perfume substantivity and longevity on dried treated fabrics.

The oil is present at a level of from 5 to 40 wt %, preferably from 8 to 35 wt %, more preferably from 10 to 30 wt % based on the total weight of the composition.

Nonionic Surfactant

A nonionic surfactant may be present in order to improve control of the melting temperature of the composition or at least to affect the temperature at which the composition flows.

Preferred nonionic surfactants are solid at ambient temperature so that, once deposited onto fabrics, they cause greater scattering light from the fabrics thereby reducing visibility of any product deposited onto the fabric.

Furthermore, the preferred nonionic surfactants have an HLB within the range 8 to 20, more preferably 10 to 20, as this significantly improves solubilisation of the active components (such as fabric softening agents which typically have a solubility of less than $1\times10^{-3}$ wt % in water at 20° C.) in the water phase at the elevated temperatures of the heating cycle.

Suitable nonionic surfactants include addition products of ethylene oxide and/or propylene oxide with fatty alcohols, fatty acids and fatty amines.

Ideally, the nonionic surfactant comprises an average degree of alkoxylation of from 8 to 40 alkoxy units per molecule, more preferably from 10 to 30, even more preferably 11 to 25, e.g. 12 to 22 alkoxy units.

Any of the alkoxylated materials of the particular type described hereinafter can be used as the nonionic surfactant.

Suitable surfactants are substantially water soluble surfactants of the general formula:

$$R—Y—(C_2H_4O)_z—C_2H_4OH$$

where R is selected from the group consisting of primary, secondary and branched chain alkyl and/or acyl hydrocarbyl groups; primary, secondary and branched chain alkenyl hydrocarbyl groups; and primary, secondary and branched chain alkenyl-substituted phenolic hydrocarbyl groups; the hydrocarbyl groups having a chain length of from 8 to about 25, preferably 10 to 20, e.g. 14 to 18 carbon atoms with coco and tallow or chain composition being most preferred.

In the general formula for the ethoxylated nonionic surfactant, Y is typically:

—O—, —C(O)O—, —C(O)N(R)— or —C(O)N(R)R— in which R has the meaning given above or can be hydrogen; and Z is preferably from 8 to 40, more preferably from 10 to 30, most preferably from 11 to 25, e.g. 12 to 22.

The degree of alkoxylation, Z, denotes the average number of alkoxy groups per molecule.

Examples of nonionic surfactants follow. In the examples, the integer defines the number of ethoxy (EO) groups in the molecule.

A. Straight-Chain, Primary Alcohol Alkoxylates

The deca-, undeca-, dodeca-, tetradeca-, and pentadeca-ethoxylates of n-hexadecanol, and n-octadecanol having an HLB within the range recited herein are useful viscosity/dispersibility modifiers in the context of this invention. The ethoxylates of mixed natural or synthetic alcohols in the "tallow" chain length range are also useful herein. Specific examples of such materials include tallow alcohol-EO(11), tallow alcohol-EO(18), and tallow alcohol-EO (25), coco alcohol-EO(10), coco alcohol-EO(15), coco alcohol-EO(20) and coco alcohol-EO(25).

B. Straight-Chain, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having an HLB within the range recited herein are useful viscosity and/or dispersibility modifiers in the context of this invention. Exemplary ethoxylated secondary alcohols useful herein as the viscosity and/or dispersibility modifiers of the compositions are: $C_{16}$ EO(11); $C_{20}$ EO(11); and $C_{16}$ EO(14).

C. Alkyl Phenol Alkoxylates

As in the case of the alcohol alkoxylates, the hexa- to octadeca-ethoxylates of alkylated phenols, particularly monohydric alkylphenols, having an HLB within the range recited herein are useful as the viscosity and/or dispersibility modifiers of the instant compositions. The hexa- to octadeca-ethoxylates of p-tri-decylphenol, m-pentadecylphenol, and the like, are useful herein. Exemplary ethoxylated alkylphenols useful as the viscosity and/or dispersibility modifiers of the mixtures herein are: p-tridecylphenol EO(11) and p-pentadecylphenol EO(18).

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

Phenolic alkoxylates are particularly preferred because they are believed to improve the delivery of anti-static benefits to fabrics treated in a tumble dryer.

D. Olefinic Alkoxylates

The alkenyl alcohols, both primary and secondary, and alkenyl phenols corresponding to those disclosed immediately hereinabove can be ethoxylated to an HLB within the range recited herein and used as the viscosity and/or dispersibility modifiers of the instant compositions.

Olefinic alkoxylates are preferred for the same reason as phenolic alkoxylates.

E. Branched Chain Alkoxylates

Branched chain primary and secondary alcohols which are available from the well-known "OXO" process can be ethoxylated and employed as the viscosity and/or dispersibility modifiers of compositions herein.

Although branched chain alkoxylates and secondary alkoxylates are within the scope of the invention, it is most preferred that any alkoxylated nonionic surfactant is an alkoxylated straight chain primary alcohol.

F. Polyol Based Surfactants

Suitable polyol based surfactants include sucrose esters such sucrose monooleates, sucrose monostearate or mixture thereof, poly glycerols, alkyl polyglucosides such as coco or stearyl monoglucosides and stearyl triglucoside and alkyl polyglycerols.

The above nonionic surfactants are useful in the present compositions alone or in combination, and the term "nonionic surfactant" encompasses mixed nonionic surface active agents.

Sucrose based surfactants are highly suitable because of their higher hydration state relative to other alkoxylkates.

The nonionic surfactant is present in an amount within the range from 2 to 30% by weight based on the total weight of the composition, preferably from 5 to 20 wt %, most preferably from 5 to 15 wt %.

Solvent

Optionally and advantageously, the compositions comprise a solvent for the active ingredient(s). The solvent further optimises the viscosity and flow temperature characteristics of the composition. Additionally, the solvent may act as a humectant retarding the loss of water from the composition upon storage.

Preferably the solvent is semi-polar.

Suitable solvents include any which have a flash point above the heating temperature of a tumble dryer. Ideally the solvent is also odourless.

Commercially available examples include polyols. Particularly preferred are glycol-based solvents such as glycol ethers. The most preferred solvent is dipropylene glycol.

The solvent is preferably present at a level of from 1 to 25%, more preferably from 2 to 20%, most preferably from 3 to 10% by weight, based on the total weight of the composition.

Preferably the weight ratio of nonionic surfactant to solvent is from 1:1 to 15:1, more preferably from 3:2 to 8:1 most preferably from 2:1 to 6:1.

The combined amount of nonionic surfactant and optional solvent is preferably less than 50% by weight of the composition, more preferably less than 47%, most preferably less than 45%.

Fabric Treatment Active Ingredient

Any active ingredient typically delivered in the rinse cycle of a laundry operation or in a tumble drying cycle is suitable for use in the compositions of the present invention.

Preferably the fabric treatment active ingredient is present in a weight excess, more preferably in a molar excess relative to the nonionic surfactant.

Ideally, the molar ratio of fabric treatment active ingredient to nonionic surfactant is within the range from 50:1 to 1:1, more preferably from 30:1 to 2:1 most preferably from 25:1 to 2:1, e.g. 5:1 to 2:1.

Preferably the weight ratio of fabric treatment active ingredient to nonionic surfactant is within the range from 100:1 to 1:3, more preferably from 50:1 to 1:2, most preferably from 25:1 to 1:1, e.g. 5:1 to 1:1.

The following are examples of commonly included active ingredients. The list is not exhaustive and it will be appreciated by the person skilled in the art that further active ingredients are equally suitable for use in the compositions of the present invention.

Antistatic Agents

Suitable antistatic agents include humectants, such as glycerol and potassium acetate, inorganic salts, such as lithium chloride, and amines, such as triethanolamine. Ionising antistatic agents are believed to be more efficient than non-ionic antistatic agents, and thus it is desirable that the agent is sufficiently hygroscopic to form a solution in equilibrium with atmosphere below 40% relative humidity.

Especially preferred antistatic agent include $NH_4$ DEFI/Fatty Acid systems containing up to 80% fatty acid, 25/75 LAS/Fatty acid systems, quaternary ammonium compounds where one or more of the alkyl groups is substituted by a poly(oxyethylene) group, perquaternised alkylene-diamine derivatives, polyamines containing poly(oxyethylene) groups, PEG 600, combinations of non-ionic and cationic surfactants as described in U.S. Pat. No. 4,058,489 preferably with both surfactants being covalently bound), combinations of a quaternary ammonium material and a non-ionic surfactant as described in Textile Month May 1983, 22, tri-methyl benzyl ammonium chloride, tri-octyl ammonium chloride, tri-methyl benzyl ammonium chloride, Gafstat S100 (ex Gaf Corp.), Alubrasol MM (ex Jordan Chem. Co.), tetrabutyl ammonium bromide preferably in combination with di-octyl dimethyl ammonium bromide, combinations of quaternary ammonium materials and magnesium or calcium salts ($CaCl_2$, $CaSO_4$, $MgSO_4$) as described in U.S. Pat. No. 3,951,879, mixtures of mono- and di-substituted alkanediamines, produced by reaction of higher alkyl-1,2-epoxides with lower alkanediamines as described in U.S. Pat. No. 4,049,557, N-substituted iminodicarboxylates as described in U.S. Pat. No. 3,725,473, alkyl ammonium carbamates of the form $R_1R_2NH_2^+O(O)CNR_3R_4$, where $R_1$ is hydrogen or an alkyl group, e.g. 1 to 22 atoms; $R_2$ is an alkyl group having 10 or more carbon atoms (preferably 10 to 22); $R_3$ and $R_4$ are each either hydrogen or an alkyl group (1 to 22 carbons) as described in U.S. Pat. No. 3,962,100, polyalkylethyleneimine of the form $—[N(R')(CH_2)_y]_z—$ where y is an integer from 1 to 4, preferably 2, z is an integer greater than 1, preferably 20 to 10000, R' is selected from the group consisting of hydrogen, and alkyl and alkanoyl substituents containing preferably from 12 to 18 carbon atoms and preferably 10 to 20% of the nitrogen atoms are substituted with alkyl and alkanoyl substituents as described in U.S. Pat. No. 3,844,952, mono- or di- long chain alkyl imidazolinium compounds as described in U.S. Pat. No. 3,959,157, mixtures of nonionic, cationic and anionic surfactants as described in U.S. Pat. No. 4,058,489

Fabric Softening Agents

Suitable fabric softening agents include cationic surfactants such as quaternary ammonium fabric softening materials and imidazolines as well as nonionic fabric softening agent.

When the fabric treatment active ingredient comprises a cationic surfactant, it is preferred that a nonionic surfactant is present. The nonionic surfactant aids the formation of a micro-emulsion by the cationic surfactant thereby increasing dissolution of the active ingredient. This increases the liquidity of the activated composition and improves deposition onto fabrics.

If the fabric softening agent is a quaternary ammonium fabric softening material, it preferably has two $C_{12-28}$ alkyl or alkenyl groups connected to the nitrogen head group, preferably via at least one ester link. It is more preferred if the quaternary ammonium material has two ester links present.

Preferably, the average chain length of the alkyl or alkenyl group is at least $C_{14}$, more preferably at least $C_{16}$. Most preferably at least half of the chains have a length of $C_{18}$.

It is generally preferred that the alkyl or alkenyl chains are predominantly linear.

The first group of cationic fabric softening compounds for use in the invention is represented by formula (I):

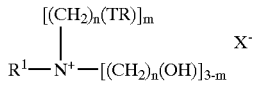

(I)

wherein each R is independently selected from a $C_{5-35}$ alkyl or alkenyl group, $R^1$ represents a $C_{1-4}$ alkyl, $C_{2-4}$ alkenyl or a $C_{1-4}$ hydroxyalkyl group, T is

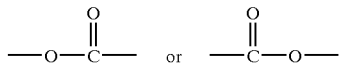

n is 0 or a number selected from 1 to 4, m is 1, 2 or 3 and denotes the number of moieties to which it relates that pend directly from the N atom, and $X^-$ is an anionic group, such as halides or alkyl sulphates, e.g. chloride, methyl sulphate or ethyl sulphate.

Especially preferred materials of this class are di-alkenyl esters of triethanol ammonium methyl sulphate. Commercial examples include Tetranyl AHT-1 (di-hardened oleic ester of triethanol ammonium methyl sulphate 80% active), AT-1(di-oleic ester of triethanol ammonium methyl sulphate 90% active), L5/90 (palm ester of triethanol ammonium methyl sulphate 90% active), all ex Kao, and Rewoquat WE15 ($C_{10}$–$C_{20}$ and $C_{16}$–$C_{18}$ unsaturated fatty acid reaction products with triethanolamine dimethyl sulphate quaternised 90% active), ex Witco Corporation.

The second group of cationic fabric softening compounds for use in the invention is represented by formula (II):

Formula (II)

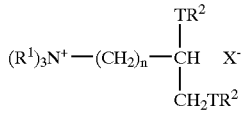

wherein each $R^1$ group is independently selected from $C_{1-4}$ alkyl, hydroxyalkyl or $C_{2-4}$ alkenyl groups; and wherein each $R^2$ group is independently selected from $C_{8-28}$ alkyl or alkenyl groups; n is 0 or an integer from 1 to 5 and T and $X^-$ are as defined above.

Preferred materials of this class such as 1,2 bis [tallowoyloxy]-3-trimethylammonium propane chloride and 1,2-bis[oleyloxy]-3-trimethylammonium propane chloride and their method of preparation are, for example, described in U.S. Pat. No. 4,137,180 (Lever Brothers), the contents of which are incorporated herein. Preferably these materials also comprise small amounts of the corresponding monoester, as described in U.S. Pat. No. 4,137,180.

A third group of cationic fabric softening compounds for use in the invention is represented by formula (III):

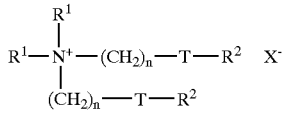

(III)

wherein each $R^1$ group is independently selected from $C_{1-4}$ alkyl, or $C_{2-4}$ alkenyl groups; and wherein each $R^2$ group is independently selected from $C_{8-28}$ alkyl or alkenyl groups; n is 0 or an integer from 1 to 5 and T and $X^-$ are as defined above. A preferred material of this class is N—N-di (tallowoyloxy ethyl) N,N-dimethyl ammonium chloride.

A fourth group of cationic fabric softening compounds for use in the invention is represented by formula (IV):

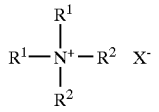

(IV)

wherein each $R^1$ group is independently selected from $C_{1-4}$ alkyl, or $C_{2-4}$ alkenyl groups; and wherein each $R^2$ group is independently selected from $C_{8-28}$ alkyl or alkenyl groups; and $X^-$ is as defined above.

It should also be appreciated that certain fabric softening agents may also deliver anti-static benefits to fabrics.

For instance, quaternary ammonium materials with one or more alkoxylate groups per molecule are believed to deliver both good softening and good antistatic to fabrics.

Fabric softening agents which also deliver anti-static benefits are particularly preferred.

The fabric treatment active ingredient is present in an amount from 3 to 75% by weight (active ingredient) based on the total weight of the composition, preferably 4 to 60% by weight, more preferably 5 to 50% by weight, most preferably 10 to 45% by weight.

Iodine Value of the Parent Fatty Acyl Group or Acid

The iodine value of the parent fatty acyl compound or acid from which the quaternary ammonium fabric softening material is formed is from 0 to 140, more preferably from 0 to 80, most preferably from 0 to 40, e.g. from 0 to 35.

An iodine value below 4 is particularly desirable as the resultant active ingredient provides excellent softening and is more resistant to odour problems upon storage. It is also believed that lower iodine values may reduce staining.

However, iodine values from 5 to 35 are also suitable as the resultant active ingredient melts more readily at the heating temperature of the tumble dryer, and can provide better anti-static benefits.

Where the quaternary ammonium material is based on a parent fatty acid or acyl compound having an iodine value of from 5 to 35, e.g. 10 to 25, it is particularly preferred that the nonionic surfactant comprises a fully saturated alkoxylated alcohol, e.g. hardened tallow 15 EO.

In the context of the present invention, the iodine value of the parent fatty acyl compound or acid from which the fabric softening material formed, is defined as the number of grams of iodine which react with 100 grams of the compound.

The method for calculating the iodine value of a parent fatty acyl compound/acid comprises dissolving a prescribed amount (from 0.1–3 g) into about 15 ml chloroform. The dissolved parent fatty acyl compound/fatty acid is then reacted with 25 ml of iodine monochloride in acetic acid solution (0.1M). To this, 20 ml of 10% potassium iodide solution and about 150 ml deionised water is added. After addition of the halogen has taken place, the excess of iodine monochloride is determined by titration with sodium thiosulphate solution (0.1M) in the presence of a blue starch indicator powder. At the same time a blank is determined with the same quantity of reagents and under the same conditions. The difference between the volume of sodium thiosulphate used in the blank and that used in the reaction with the parent fatty acyl compound or fatty acid enables the iodine value to be calculated.

Perfume

It is desirable that the compositions of the present invention also comprise one or more perfumes. Suitable perfume ingredients include those disclosed in "Perfume and Flavor Chemicals (Aroma Chemicals)", by Steffen Arctander, published by the author in 1969, the contents of which are incorporated herein by reference.

The inventors have found that up to 10 wt % perfume can be incorporated in the compositions of the present invention without destabilising the composition. Such levels are significantly higher than those present in commercially available tumble dryer sheets. Accordingly, better perfume substantivity and longevity can be achieved from the present compositions than from traditional tumble dryer sheets.

Fatty Component

The compositions of the present invention may comprise a fatty component such as a fatty acid and/or a fatty alcohol.

Suitable fatty acids/alcohols have a hydrocarbyl chain length of from 8 to 26 carbon atoms, more preferably 12 to 22, most preferably from 12 to 20 carbon atoms.

Preferred fatty acids include hardened tallow fatty acid (available under the tradename Pristerene, ex Uniqema).

Preferred fatty alcohols include hardened tallow alcohol (available under the tradenames Stenol and Hydrenol, ex Cognis and Laurex CS, ex Albright and Wilson) and behenyl alcohol, a C22 chain alcohol, available as Lanette 22 (ex Henkel).

The fatty acid and/or alcohol is preferably present in an amount of from 0.5% to 15% by weight based on the total weight of the composition, more preferably 1 to 10%, most preferably 1.5 to 7% by weight.

Other Co-Active Ingredients

Other co-active ingredients for the fabric treatment active ingredient may also be incorporated in an amount from 0.01 to 20% by weight, more preferably 0.05 to 10%, based on the total weight of the composition. Preferred ingredients of this type include fatty esters, and fatty N-oxides.

Preferred fatty esters include fatty monoesters, such as glycerol monostearate. If GMS is present, then it is preferred that the level of GMS in the composition, is from 0.01 to 10 wt %, based on the total weight of the composition.

Polymeric Viscosity Control Agents

A polymeric viscosity control agent may also be present in the compositions of the invention. Suitable polymeric viscosity control agents include nonionic and cationic polymers, such as hydrophobically modified cellulose ethers (e.g. Natrosol Plus, ex Hercules) and cationically modified starches (e.g. Softgel BDA and Softgel BD, both ex Avebe). A particularly preferred viscosity control agent is a copolymer of methacrylate and cationic acrylamide available under the tradename Flosoft 200 (ex SNF Floerger).

Polymeric viscosity control agents are preferably present in an amount of from 0.01 to 5 wt %, more preferably 0.02 to 4 wt %, based on the total weight of the composition.

Other Optional Ingredients

The compositions may also contain one or more optional ingredients conventionally included in fabric conditioning compositions such as pH buffering agents, perfume carriers, fluorescers, colourants, antifoaming agents, antiredeposition agents, polyelectrolytes, enzymes, optical brightening agents, anti-shrinking agents, anti-wrinkle agents, anti-spotting agents, germicides, fungicides, anti-corrosion agents, drape imparting agents, ironing aids and dyes.

EXAMPLES

The invention will now be illustrated by the following non-limiting examples. Further modifications within the scope of the invention will be apparent to the person skilled in the art.

Samples of the invention are represented by a number. Comparative samples are represented by a letter.

All values are % by weight of the active ingredient unless stated otherwise.

The samples in table 1 were prepared as follows:

The quat, oil and optional solvent were weighed in a beaker and heated on a hot plate until molten (about 70° C.). Hot water (also about 70° C.) was then slowly dosed into the molten mixture with stirring. To this mixture, perfume was added and stirring continued until a 'clear' liquid was produced. The liquid was bottled and left to cool either in the bottle or on a rotary blender.

TABLE 1

| Sample | 1 | 2 | 3 | A | B | C |
|---|---|---|---|---|---|---|
| Quat (1)* | 50 | 50 | 50 | 80 | 50 | 50 |
| Sirius M85 (2) | 20 | 0 | 0 | 0 | 0 | 0 |
| NP-35 (3) | 0 | 20 | 0 | 0 | 0 | 0 |
| Estol 1545 (4) | 0 | 0 | 20 | 0 | 0 | 0 |
| DPG (5) | 5 | 5 | 5 | 10 | 0 | 5 |
| PEG 200 (6) | 0 | 0 | 0 | 0 | 25 | 0 |
| Glycerol | 0 | 0 | 0 | 0 | 0 | 20 |
| Perfume | 5 | 5 | 5 | 5 | 5 | 5 |
| Water | 20 | 20 | 20 | 5 | 20 | 20 |

(1) Stepantex VL85G (85%), tallow (IV about 35) based TEA quaternary ammonium material with 15% DPG solvent (ex Stepan)
(2) mineral oil, ex Fuchs
(3) mineral oil, ex Emca
(4) ester oil, ex Uniqema
(5) dipropylene glycol (ex Dow Chemicals). This was present in addition to any DPG present in the raw material of the quaternary ammonium material.
(6) polyethylene glycol 200, ex Clariant
For materials in table marked "*", the amount denotes the level of raw material including solvent.

Staining Evaluation

Staining evaluation was then carried out on the fabrics identified in Table 2.

TABLE 2

| Garment | Fabric type | Colour | Texture |
|---|---|---|---|
| Single jersey | 100% acrylic | Multicolour | Knitted, thick |
| Sport trousers | 100% nylon | buff | Woven with woven nylon lining, light |
| Green shirt | 100% cotton | Green | Woven, light |
| Blue shirt | 100% Polyester | Blue | Woven peach skin (brushed), heavy |
| Fleece | 52% polyester 40% cotton 8% lastane | | Towel looped knit, heavy |
| Jeans trousers | 100% cotton | Blue | Denim |
| Cotton monitor | 100% cotton | Black | Woven, light |
| Microfibre monitor | 100% polyester | Pearly | Woven, light |
| Pongee monitor | 100% polyester | Pink | Tuffata, lining type |

A 1.5 kg load was washed in a Miele Novotronic W820 washing machine using 80 g of un-perfumed Persil fabric washing powder at a 40° C. wash temperature. The fabrics were spin dried and then transferred to a Miele Novotronic T43 tumble dryer.

The dispensing device—as described on page 16 line 26 to page 20 line 12 and shown in FIGS. 1, 3 and 4 of WO-A1-02/33161 having a membrane thickness of 160 $\mu$m, a membrane pore size of 0.2 $\mu$m and membrane area of 1080 $mm^2$—was charged with 30 g of the sample and then attached to the internal side of the door of the tumble dryer and the 60 minutes "Cotton Extra Dry" drying cycle started. At the end of the cycle the fabrics were removed. Comparative evaluation with tumble dryer sheets was also made (for each cycle a single tumble dryer sheet was used).

Staining was evaluated by a panel of trained laboratory personnel in a standard Viewing Cabinet (D65 light, simulating typical northern hemisphere outdoor light). The panel assessed the staining of the aqueous compositions with a critical eye using different viewing angles and observing over a black background.

Unless otherwise indicated, each sample was assessed 3 times with the fabric being washed as described above between each assessment.

Staining was ranked according to the number of stains and the size/visibility of the stains on a scale of from 0 to 5 where 0 represented no staining and 5 represented severe staining.

The results are given in table 3 below.

TABLE 3

| Sample | TDS (1) | TDS (2) | 1 | A |
|---|---|---|---|---|
| Microfibre | 2.5 | 0 | 1 | 2 |
| Pongee | — | — | 1 | 3 |
| Jeans | 0 | 0 | 0 | 0.5 |

(1) Bounce - purchased in UK 2001
(2) Snuggle - purchased in US 2001

Delivery Evaluation

The following compositions were prepared according to the method described above.

TABLE 4

| Sample | 4 | 5 | 6 | 7 | 8 | D | E |
|---|---|---|---|---|---|---|---|
| Quat (1)* | 50 | 55 | 50 | 55 | 50 | 50 | 55 |
| DC 245 (2) | 25 | 20 | 0 | 0 | 0 | 0 | 0 |
| NP-35 (3) | 0 | 0 | 20 | 20 | 0 | 0 | 0 |
| Estol 1545 (4) | 0 | 0 | 0 | 0 | 20 | 0 | 0 |
| DPG (5) | 0 | 0 | 5 | 0 | 5 | 0 | 0 |
| DPnB (6) | 0 | 0 | 0 | 0 | 0 | 25 | 40 |
| Perfume | 5 | 5 | 5 | 5 | 5 | 5 | 5 |
| Water | 20 | 20 | 20 | 20 | 20 | 20 | 0 |

(1) Stepantex UL G80 (80%), hardened tallow (IV < 1) based TEA quaternary ammonium material with 20% DPG solvent (ex Stepan)
(2) Volatile silicone oil, ex Dow Chemicals
(3) mineral oil, ex Emca
(4) ester oil, ex Uniqema
(5) ester oil, ex Uniqema
(5) dipropylene glycol (ex Dow Chemicals). This was present in addition to any DPG present in the raw material of the quaternary ammonium material.
(6) dipropyl glycol n-butyl ether.
"*" denotes the level of raw material including solvent.

Delivery evaluation was carried out as follows:

Approximately 30 g of the sample to be evaluated was transferred to a dispensing device—described above. The device was then attached to the inside of the door of the Miele tumble dryer and the 60-minute "Cotton extra dry" heating cycle started.

For each sample, the amount of product delivered was measured at intervals during the heating cycle.

Delivery of between 1 and 2 grams of product during the 60 minute cycle was desirable. Below this amount, insufficient active ingredient would be delivered to the fabric. Significantly greater amounts than this would cause staining problems.

The amount in grams of each sample delivered is given in table 5.

TABLE 5

| Time/mins | 0 | 10 | 20 | 30 | 40 | 50 | 60 |
|---|---|---|---|---|---|---|---|
| Sample 5 | 0 | 0.04 | 0.11 | 0.28 | 0.5 | 0.76 | 1.06 |
| Sample 6 | 0 | 0.2 | 0.5 | 0.7 | 0.9 | 1.2 | 1.4 |
| Sample 7 | 0 | 0.05 | 0.14 | 0.38 | 0.68 | 0.92 | 1.04 |
| Sample 8 | 0 | 0.5 | 0.67 | 1.11 | 1.3 | 1.59 | 1.8 |
| Sample D | 0 | 0.26 | 2.88 | — | — | — | — |
| Sample E | 0 | 0.89 | 2 | — | — | — | — |

For samples D and E, delivery was ceased after approximately 20 minutes due to the excess of product delivered.

Staining Evaluation

Staining evaluation of the samples of table 4 was then carried out on the garments identified in table 2. Evaluation was made according to the method described in the example above.

The results are given in table 6

TABLE 6

| Garment | Sample 5 | Sample 7 | Sample 8 | Sample D | Sample E |
|---|---|---|---|---|---|
| Single jersey | 0 | 0.5 | — | — | — |
| Sport trousers | 0 | 0 | — | — | — |
| Green shirt | 0.5 | 0 | — | — | — |
| Blue shirt | 0.5 | 0 | — | — | — |
| Fleece | 0.5 | 1 | — | — | — |
| Jeans trousers | 0 | 0.5 | — | — | — |
| Cotton monitor | 1 | 0 | 0.5 | 2.5 | 1.5 |
| Microfibre monitor | 0.5 | 0.5 | 1 | 3 | 2.5 |
| Pongee monitor | 0.5 | 0 | 1.5 | 4 | 3 |

"—" denotes not measured.

Perfume Evaluation

Perfume evaluation was also carried out using samples 4 to 8 and a standard commercially available tumble dryer sheet (Bounce, purchased in UK in 2001) over 10 wash and dry cycles.

A 1.5 kg load containing equal weight mixtures of cotton, polycotton, polyester, nylon, acrylic, microfibre monitors and pongee polyester monitors was washed as described above. The washed articles were spin dried and transferred to a Hotpoint Aquarius Tumble Dryer and then tumble dried for 60 minutes. This process was repeated 10 times, with the dispensing device remaining in position and without being recharged. After each cycle the articles were removed and assessed then washed and the cycle repeated until 10 cycles completed. For the sample containing the tumble dryer sheet, a new sheet was introduced before each drying cycle.

For each of the samples 4 to 8, perfume strength on fabrics after each drying cycle was significantly stronger than perfume strength on fabrics treated with the tumble dryer sheet.

Further Staining Evaluation

The following compositions were prepared by weighing the quat, oil, nonionic and optional solvent into a beaker and heating on a hot plate until molten (about 70° C.). Hot water (also about 70° C.) was then slowly dosed into the molten mixture with stirring. Perfume was added and stirring continued until a 'clear' liquid was produced. The liquid was left to cool either in a bottle or on a rotary blender.

TABLE 7

| Sample | 9 | 10 | 11 | 12 | 13 |
|---|---|---|---|---|---|
| Quat (1)* | 20 | 0 | 40 | 35 | 40 |
| Quat (2)* | 0 | 20 | 0 | 0 | 0 |
| Emnon SCR-PK (3) | 30 | 30 | 0 | 0 | 0 |
| Squalane 99% (4)* | 0 | 0 | 20 | 0 | 0 |
| Semtol 70/28 (5) | 0 | 0 | 0 | 15 | 0 |
| Sirius M40 (6) | 0 | 0 | 0 | 0 | 20 |
| Nonionic coco 11EO (ex Slovasol) | 20 | 20 | 5 | 10 | 5 |
| Dipropylene glycol | 5 | 5 | 0 | 0 | 0 |
| Water | 20 | 20 | 30 | 35 | 30 |
| Perfume | 5 | 5 | 5 | 5 | 5 |

(1) Stepantex ULG60 80% (DPG 20%) a hardened tallow TEA Quaternary ammonium material (IV < 1) (ex Stepan)
(2) Stepantex VL85G (85%) (15% DPG) a tallow TEA (IV about 35) quaternary ammonium material (ex Stepan)
(3) A sugar ester oil based on palm kernel (ex KAO)
(4) A natural oil (ex Aldrich)
(5) A white mineral oil (ex Goldschmidt)
(6) A white medicinal quality mineral oil (ex Silkolene)
"*" denotes the level of raw material including solvent.

All above formulations produced microemulsions at the heating temperature of a tumble dryer.

Staining performance was evaluated according to the method described in the examples above. The results are given in table 8.

TABLE 8

| Sample | TDS (1) | 9 | 11 | 12 | 13 |
|---|---|---|---|---|---|
| black monitor | 0.5–1 | 0.5 | 0.5–1.0 | 0.5 | 0.5 |
| blue shirt | 0.5–1.0 | 1.0–1.5 | 0.5 | 0.5–1.0 | 0.0–0.5 |
| Pongee | 0.5–1.0 | 0 | 0 | 0.5 | 0 |
| green shirt | 0 | 0 | 0 | 0 | 0 |
| microfibre (monitor) | 0.5 | 0.5–1.0 | 0–0.5 | 0.5 | 0 |
| sport trousers | 0 | 0.5 | 0 | 0 | 0 |
| Fleece | 0 | 0 | 0 | 0 | 0 |
| Jeans | 0 | 0 | 0 | 0 | 0 |
| Jersey | 0 | 0 | 0 | 0 | 0 |

(1) Bounce, purchased UK 2001.

What is claimed is:

1. A heat activated fabric treatment composition comprising:

(a) from about 3 to about 75 wt % of one or more fabric treatment active ingredients comprising a quaternary ammonium material;

(b) from about 10 to about 50 wt % of water;

(c) from about 5 to about 40 wt % of an oil comprising a natural plant-based oil; and (d) from about 2 to about 30 wt % of a nonionic surfactant.

2. A heat activated fabric conditioning composition as claimed in claim 1 wherein the oil comprises a volatile silicone oil.

3. A heat activated fabric conditioning composition as claimed in claim 1 wherein the nonionic surfactant comprises an ethoxylated alcohol having from about 12 to about 20 EO groups.

4. A heat activated fabric conditioning composition as claimed in claim 1 wherein the weight ratio of fabric treatment active ingredient to nonionic surfactant is from about 100:1 to about 1:3.

5. A heat activated fabric conditioning composition as claimed in claim 1 wherein the weight ratio of fabric treatment active ingredient to nonionic surfactant is from about 50:1 to about 1:2.

6. A heat activated fabric conditioning composition as claimed in claim 1 wherein the weight ratio of fabric treatment active ingredient to nonionic surfactant is from about 5:1 to about 1:1.

7. A package comprising the heat activated composition of claim 1 within a dispensing device.

8. A method of conditioning fabrics in a tumble dryer comprising locating the package of claim 7 on the internal panel of the door of the tumble dryer, inserting fabrics into the tumble dryer and operating the dryer to cause at least a part of the fabric treatment composition to be dispensed from the device onto the fabrics being dried so as to condition the fabrics.

9. A method of conditioning fabrics in a tumble dryer comprising:

locating a package comprising a heat activated fabric treatment composition within a dispensing device on an internal panel of the door of a tumble dryer;

inserting fabrics into said tumble dryer; and operating said dryer to cause at least a part of said composition to be dispensed from said device onto said fabrics being dried so as to condition the fabrics;

wherein said heat activated fabric treatment composition comprises:

(a) about 3 to about 75 wt % of one or more fabric treatment active ingredients comprising a quaternary ammonium material;

(b) about 10 to about 50 wt % of water;

(c) about 5 to about 40 wt % of volatile silicone oil; and (d) optionally about 2 to about 30 wt % of nonionic surfactant.

* * * * *